US005697603A

United States Patent [19]

Kato

[11] Patent Number: 5,697,603

[45] Date of Patent: Dec. 16, 1997

[54] SHEET-SUPPLY DEVICE

[75] Inventor: Hiroyuki Kato, Nagoya, Japan

[73] Assignee: Brother Kogyo Kabushiki Kaisha, Aichi-ken, Japan

[21] Appl. No.: 706,236

[22] Filed: Sep. 4, 1996

[30] Foreign Application Priority Data

Sep. 6, 1995 [JP] Japan ..... 7-229398

[51] Int. Cl.[6] ..... B65H 3/06

[52] U.S. Cl. ..... 271/114; 271/10.12; 271/119; 271/126

[58] Field of Search ..... 271/10.12, 114, 271/118, 119, 126, 127

[56] References Cited

U.S. PATENT DOCUMENTS 5,582,399 12/1996 Sugiura ..... 271/119

FOREIGN PATENT DOCUMENTS

000529538 A1 5/1993 European Pat. Off. ..... 271/10.12
60-183440 9/1985 Japan .
0138034 5/1990 Japan ..... 271/119
0193830 7/1990 Japan ..... 271/114

*Primary Examiner*—H. Grant Skaggs
*Attorney, Agent, or Firm*—Oliff & Berridge

[57] ABSTRACT

Sheet-supply device including a sheet support supporting a stack of cut sheets including an uppermost sheet; a rotatable sheet-supply roller having a rotational shaft and an outer peripheral surface around the rotational shaft, the peripheral surface including a sheet contact portion and a sheet non-contact portion alternately in confrontation with the uppermost sheet depending on the rotational phase of the sheet-supply roller, the sheet contact portion and the rotational shaft having a distance therebetween greater than a distance between the non-contact portion and the rotational shaft; drive unit capable of switching between a transmission condition for transmitting rotational force to the sheet-supply roller and a non-transmission condition for interrupting transmission of rotational force to the sheet-supply roller, the drive unit serially feeding cut sheets from the sheet support by switching to the transmission condition and rotating the sheet-supply roller with the sheet contact portion in contact with the uppermost cut sheet; and a bearing member abutting, when the drive unit is in the non-transmission condition, the uppermost cut sheet to support the sheet-supply roller oriented with the sheet non-contact portion in confrontation with the uppermost cut sheet.

21 Claims, 4 Drawing Sheets

SHEET-SUPPLY DEVICE

BACKGROUND OF THE INVENTION

1. Field of the Invention

The present invention relates to a sheet-supply device for feeding sheets to a printer.

2. Description of the Related Art

There has been known a type of sheet-supply device including a sheet-support tray stacked with cut sheets and a sheet-supply roller for removing one sheet at a time from the stack in the sheet-support tray by rotating while in a contact with the uppermost one of the stack of sheets.

The following text is an explanation of a conventional sheet-supply device. A sheet-supply roller of the conventional device includes an arc-shaped sheet-contact portion and a sheet non-contact portion. The distance between the rotational shaft and the outer surface is greater at the sheet-contact portion than at the non-contact portion. The conventional device is capable of switching between a drive transmission condition where rotational force is transmitted to the sheet-supply roller and a non-drive transmission condition wherein transmission of rotational force to the sheet-supply roller is interrupted. When a sheet is not to be supplied, transmission of rotational force to the sheet-supply roller is interrupted while the sheet non-contact portion of the sheet-supply roller is in confrontation with the uppermost sheet of the stack of sheets. Because the sheet non-contact portion is in confrontation with the uppermost sheet, when transport rollers disposed downstream from the sheet-supply roller take up and transport a sheet initially feed out by the sheet-supply roller, the sheet-contact portion will not contact and apply resistance to the transported sheet. Interrupting transmission of drive force to the sheet-supply roller in this manner requires a simpler configuration and a simpler control process than when a stepping motor for controlling starts and stops of the sheet-supply roller is connected to the sheet-supply roller.

SUMMARY OF THE INVENTION

However, because the radius of the sheet-contact portion and the sheet non-contact portion of the sheet-supply roller are different, the center of the gravity of the sheet-supply roller becomes eccentric with respect to the rotational axis of the sheet-supply roller. Between supply operations of cut sheets, the sheet-supply roller is stopped with the non-contact portion confronting the uppermost sheet and with the sheet-contact portion supported above the non-contact portion. In other words, the majority of the sheet-supply roller is disposed above the rotational axis of the sheet-supply roller. When transmission of the rotational force to the sheet-supply roller is interrupted, the weight of the sheet-supply roller can cause the sheet-supply roller to rotate. When the transport rollers are transporting a print sheet, the sheet-contact portion can contact the sheet and apply resistance thereto. Also, the initial position of the sheet roller can be put out of alignment so that the timing of a subsequent sheet-supply operation can be adversary affected.

It is an objective of the present invention to provide a sheet-supply device capable of properly preventing the sheet-supply roller from rotating when transmission of rotational force to the sheet-supply roller is interrupted.

In order to achieve the above-described objectives, a sheet-supply device according to the present invention includes a sheet support supporting a stack of cut sheets including an uppermost sheet; a rotatable sheet-supply roller having a rotational shaft and an outer peripheral surface around the rotational shaft, the peripheral surface including a sheet contact portion and a sheet non-contact portion alternately in confrontation with the uppermost sheet depending on the rotational phase of the sheet-supply roller, the sheet contact portion and the rotational shaft having a distance therebetween greater than a distance between the non-contact portion and the rotational shaft; drive means capable of switching between a transmission condition for transmitting rotational force to the sheet-supply roller and a non-transmission condition for interrupting transmission of rotational force to the sheet-supply roller, the drive means serially feeding cut sheets from the sheet support by switching to the transmission condition and rotating the sheet-supply roller with the sheet contact portion in contact with the uppermost cut sheet; and a bearing member abutting, when the drive means is in the non-transmission condition, the uppermost cut sheet to support the sheet-supply roller oriented with the sheet non-contact portion in confrontation with the uppermost cut sheet.

With this configuration, the bearing member supports the sheet-supply roller in a phase with the non-contact portion in confrontation with the uppermost sheet P in the stack while transmission of rotational power to the sheet-supply roller is interrupted. Because the bearing member supports the sheet-supply roller while transmission of rotational power to the sheet-supply roller is interrupted, undesirable rotation of the sheet-supply roller can be prevented. Because the bearing member supports the sheet-supply roller by abutting the surface of the uppermost sheet in the stack, undesirable rotation of the sheet-supply roller can be reliably prevented. Also, the sheet contact portion can be prevented from contacting and applying resistance to a sheet partially transported downstream from the sheet-supply roller in the sheet transport direction. In this way, the sheet contact portion will not interfere with timing of print sheets.

When the bearing member is plate shaped, disposed substantially perpendicular to the rotational shaft, and contacts the uppermost sheet at only its edge, the bearing member contacts the uppermost sheet at only a small surface area. Also, when the edge of the bearing member is disposed parallel to the direction in which sheets are transported, the bearing member will only apply a slight resistance to sheets being transported from the stack so that supply of sheets can be smoothly performed.

According to another aspect of the invention, a gap maintenance means is provided to reliably maintain a predetermined gap between the uppermost sheet and the rotational axis so that resistance applied to transported sheets can be further reduced.

According to still another aspect of the invention, the bearing member is fixed to rotate integrally with the rotational shaft and abuts the uppermost sheet in a manner to prevent the sheet-supply roller from being rotated by its own weight. With this configuration, the sheet-supply roller can be effectively prevented from rotating by its own weight.

According to a still further aspect of the invention, one of the sheet support and the sheet-supply roller is urged to press against the other. This insures good contact between the sheet-supply roller and the uppermost sheet, thereby improving reliability of sheet feed operations. Further, the gap maintenance means is a disk provided freely rotatable to the rotational shaft and abutting the uppermost sheet and so will freely rotate with transport of sheets and apply only a slight resistance to the transported sheets.

According to still another aspect of the present invention, the sheet support is capable of supporting a variety of different sized sheets so that all different sized sheets are supported with at least one position in common. Additionally, the bearing member is disposed so as to abut the one common position. Therefore, the bearing member can reliably prevent rotation of the sheet-supply roller regardless of what sized sheet is supported on the sheet support.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENTS

Figure 1:
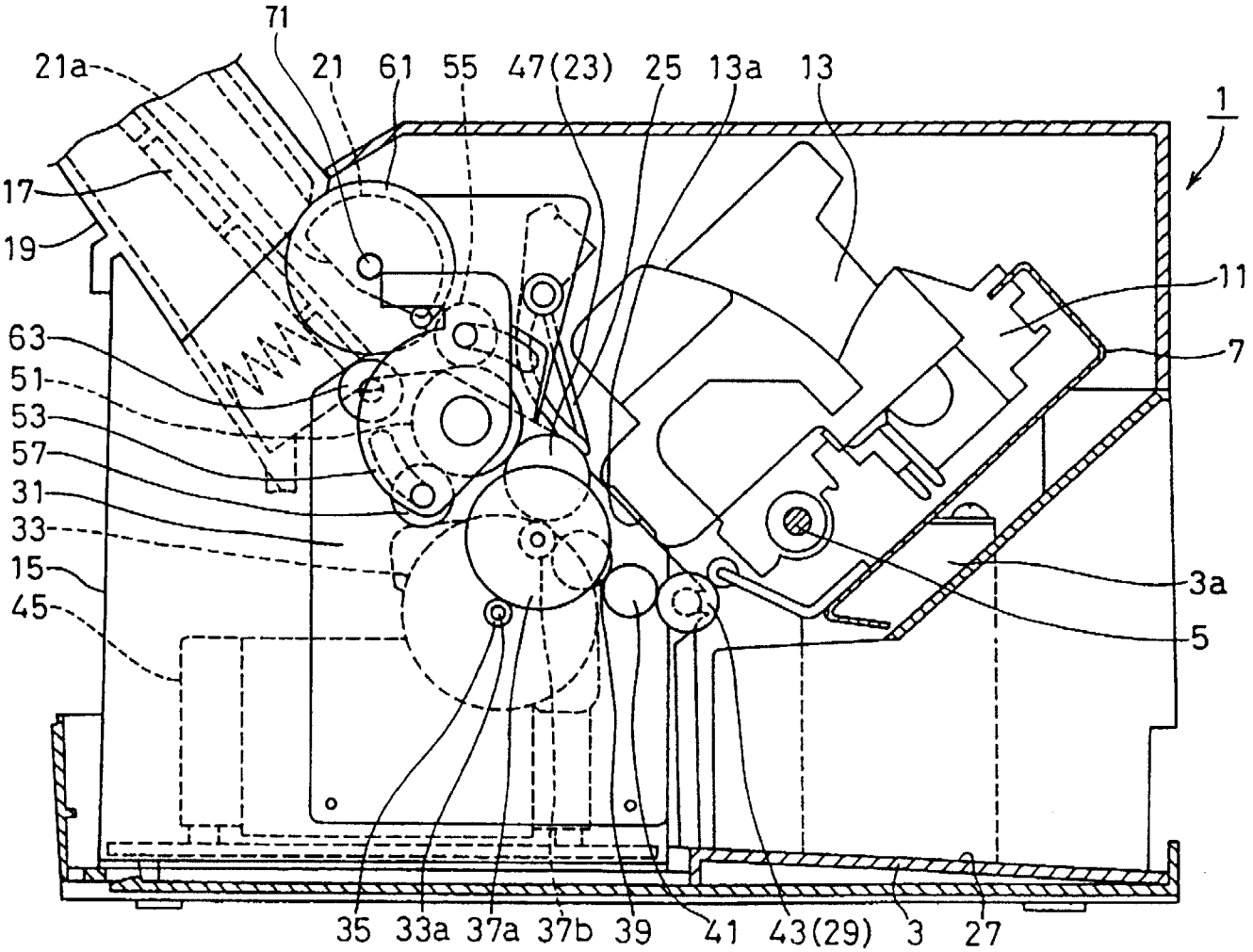
FIG. 1 is a side view showing a sheet-supply device according to an embodiment of the present invention.

A sheet-supply device according to a preferred embodiment of the present invention will be described while referring to the accompanying drawings wherein like parts and components are designated by the same reference numerals to avoid duplicating description.

FIG. 1 is a cross-sectional view showing configuration of an ink jet printer 1 to which the present invention has been applied. As shown in FIG. 1, an upright support portion 3*a* is provided to a base frame 3 of the ink jet printer 1. A circular-columnar shaped rail 5 and a plate-shaped rail 7 bent into a substantially C-shape is fixed to the support portion 3*a*. A carriage 11 is mounted on the rails 5, 7 so as to be reciprocally movable following the rails 5, 7. An ink jet type print head 13 is mounted on the carriage 11. A resin box 15 is fixed to the upper portion of the base frame 3. The print head 13 includes an ink ejection surface 13*a* in confrontation with the resin box 15.

A sheet-supply cassette 19 is detachably mounted on the upper portion of the box 15. The sheet-supply cassette 19 includes a sheet-support tray 17 stacked with a plurality of cut sheets P. A sheet-supply roller 21 formed in a substantially half-moon shape and for transporting one sheet at a time from the cut sheets stacked on the sheet-support tray 17 is supported on a rotational shaft 71 at the base of the sheet-supply cassette 19. A transport roller 23 for picking up sheets P fed out by the sheet-supply roller 21 and transporting them into confrontation with the ink ejection surface 13*a* is provided near the ink ejection surface 13*a* along a transport pathway along which sheets are transported. It should be noted that the transport roller 13 shares the same shaft and has the same radius as a gear 47 to be described later. A sheet-pressing member 25 is disposed in confrontation with the transport roller 23 on the opposite side of the sheet-transport pathway. A spring (not shown in the drawings) urges the sheet-pressing member 25 against the transport roller 23 and into pressing contact with the sheet P transported between the sheet-pressing member 25 and the transport roller 23. A discharge roller 29 sharing the same shaft and has the same radius as a gear 43 to be described later is disposed on the opposite side of the print head 13 with respect to the transport roller 23. The discharge roller 29 discharges sheets with images from the print head 13 onto a discharge tray 27 formed on the upper surface of the base frame 3. It should be noted that a guide surface for guiding sheets along the sheet-transport pathway is formed on the upper surface of the box 15.

A metal plate 31 is fixed to the side surface of the box 15. A mechanism for driving the sheet-supply roller 21, the transport roller 23, and the discharge roller 29 is provided to the upper surface of the metal plate 31. A motor 33 capable of rotating in forward and reverse directions is provided within the box 15. The motor 33 has a rotational shaft 33*a* on which is fixed a small-radius gear 35 protruding from the metal plate 31. A large-radius gear 37*a* is meshingly engaged with the small-radius gear 35. A small-radius gear 37*b* is integrally formed with the large-radius gear 37*a*. The large-radius gear 37*a* and the small-radius gear 37*b* will be collectively referred to as the gear 37 hereinafter unless necessity requires their division. The small-radius gear 37*b* is meshingly engaged via gears 39, 41 with a gear 43 which rotates integrally with the discharge roller 29. A power source 45 for supplying power to the motor 33 is disposed within the box 15.

The small gear 37*b* is meshingly engaged with the gear 47, which rotates integrally with the transport roller 23. The gear 47 is meshingly engaged with a sun gear 51. A swing frame 53 is freely swingably provided on the rotational shaft of the sun gear 51 and swings in the same direction as the rotational direction of the sun gear 51. Planetary gears 55, 57 engaged with the sun gear 51 are provided at either tip of the swing frame 53. A sheet-supply gear 61 rotates integrally with the sheet-supply roller 21. The planetary gear 55 meshingly engages with the sheet-supply gear 61 when the swing frame 53 swings counterclockwise as viewed in FIG. 1. Contrarily, the planetary gear 57 meshingly engages with the sheet-supply gear 61 via the gear 63 when the swing frame 53 swings clockwise as viewed in FIG. 1.

Figure 2:
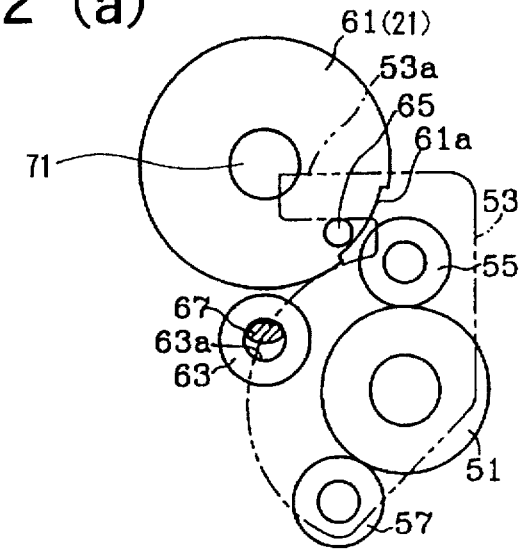
FIGS. 2(*a*) through 2(*c*) are side views showing essential components of a mechanisms for transmitting drive power to a sheet-supply roller of the sheet-supply device.
Figure 2:
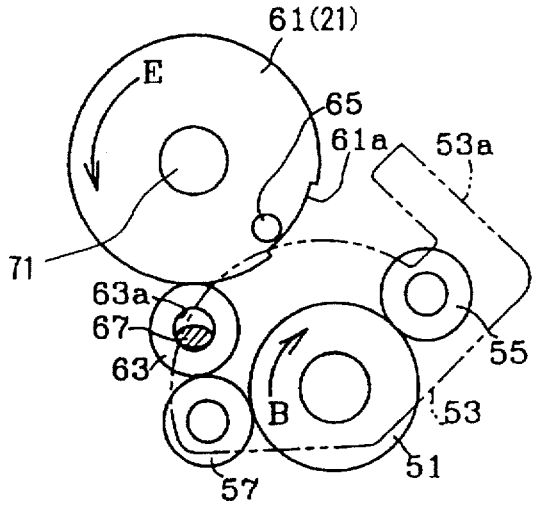
Figure 2:
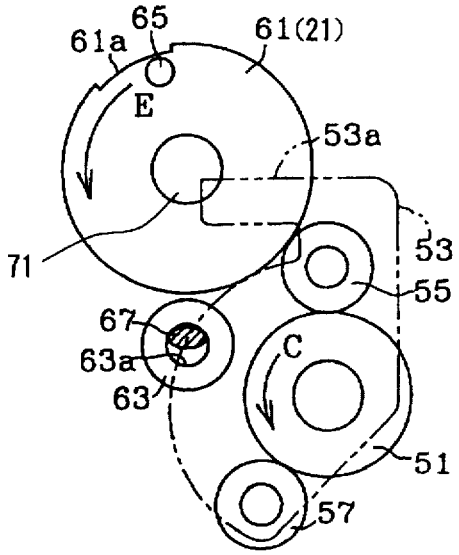

FIGS. 2(*a*) through 2(*c*) are side views showing configuration of gear mechanisms in the vicinity of the sheet-supply gear 61. An engagement rib 53*a* is formed in the swing frame 53 adjacent to the planetary gear 55 so as to protrude toward the substantial center of the sheet-supply gear 61. A pin 65 is provided at the surface of the sheet-supply gear 61 at a position so as to engage with the engagement rib 53*a* when the swing frame 53 swings clockwise, as viewed in FIG. 1, while the sheet-supply roller 21 is disposed in a stop posture to be described later. Also, the sheet-supply gear 61 includes a toothless portion 61*a* to which no gear teeth are formed. The toothless portion 61*a* is positioned so as to confront the planetary gear 55 when the pin 65 and the engagement rib 53*a* are in engagement.

The gear 63 is formed with a circular hole 63*a* near its center and is freely rotatably supported on a shaft 67 extending through the hole 63*a* directly beneath the sheet-supply gear 61 and protruding from the box 15. The shaft 67 has an ellipsoidal shape in cross section with a minor axis extending vertically in parallel with the shaft of the sheet-supply roller 21. The gear 63 is capable of shifting upward and downward in the minor axis direction of the ellipsoidal shape of the shaft 67 to engage with and disengage from the sheet-supply gear 61 accordingly.

Figure 3:
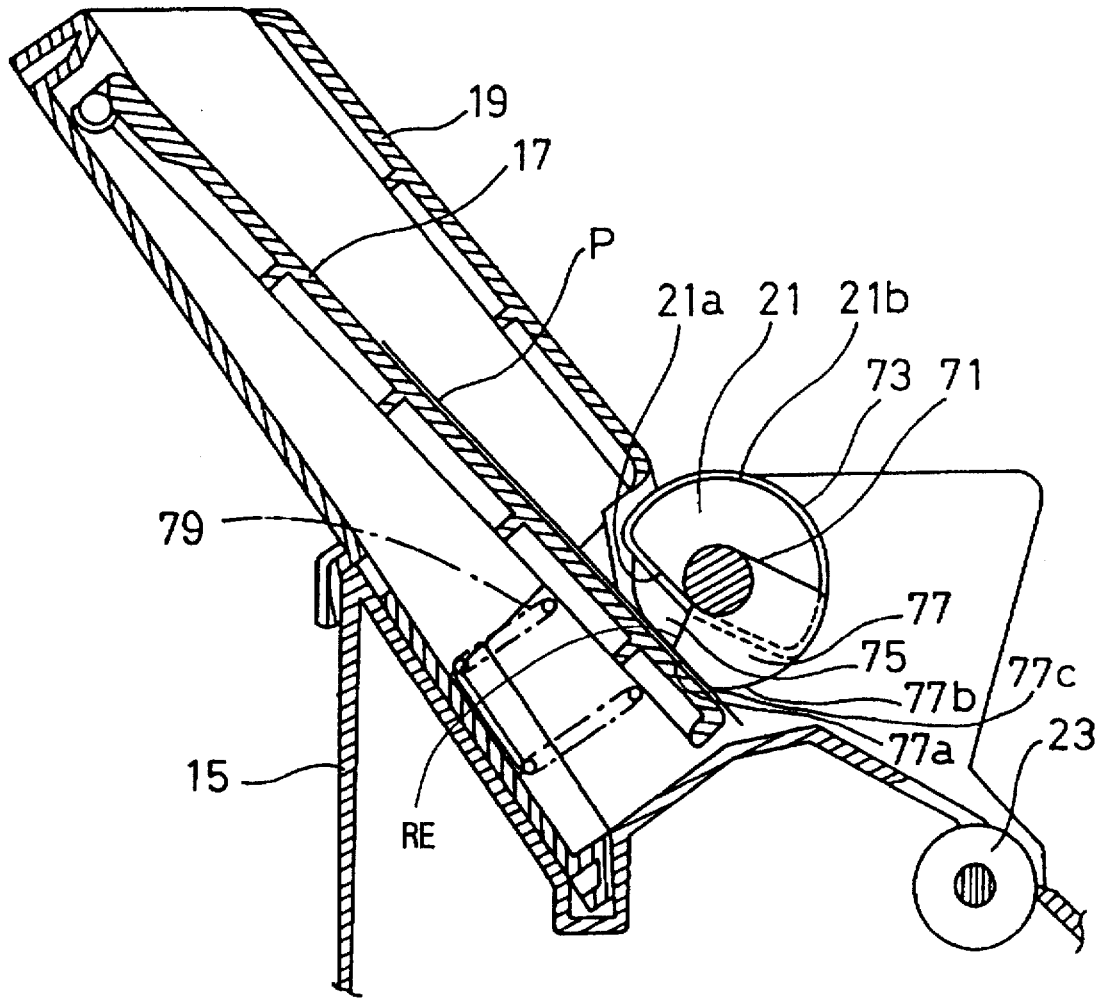
FIG. 3 is a side view showing a stopper and other components in the vicinity of the sheet-supply roller.
Figure 4:
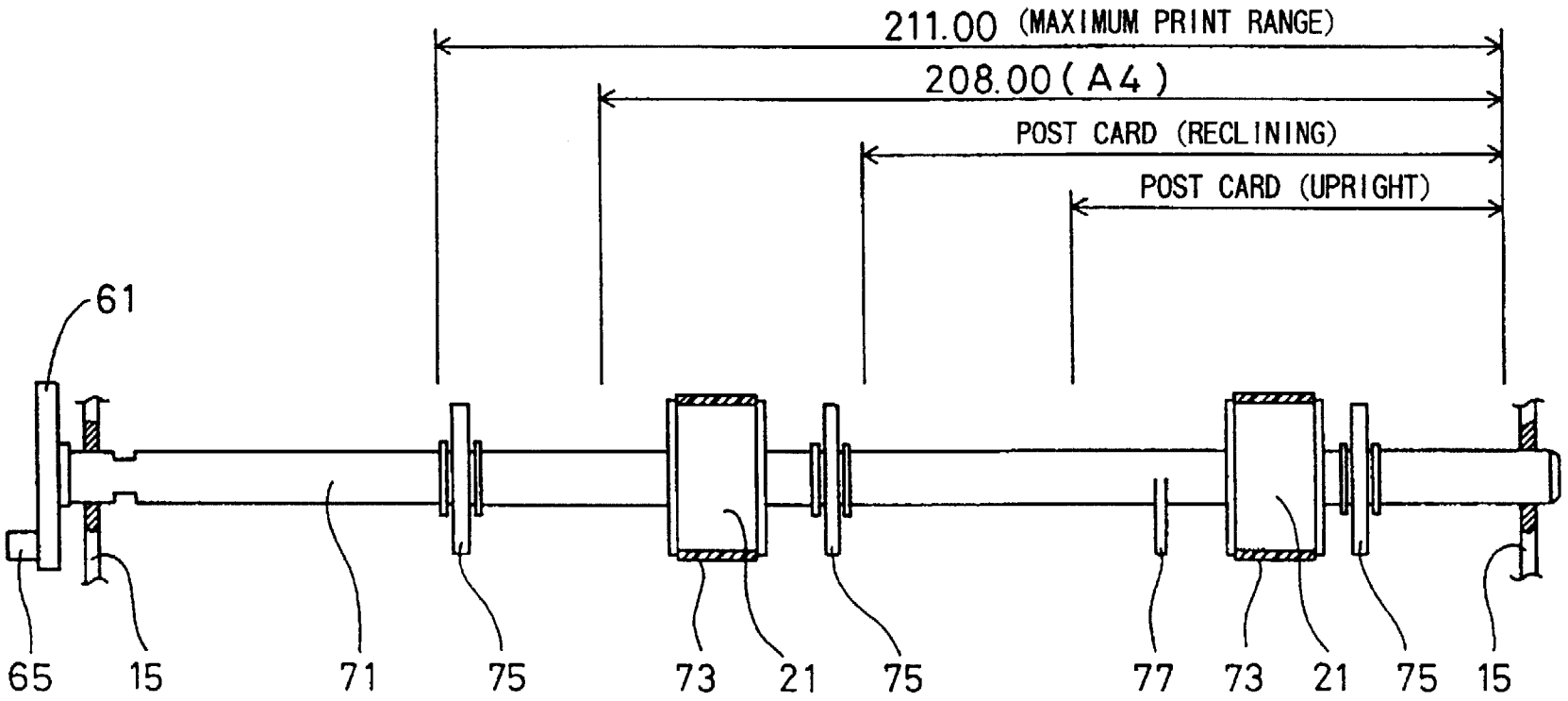
FIG. 4 is a side view showing the sheet-supply roller and other components disposed on a rotational shaft of the sheet-supply roller.

FIG. 3 is a cross-sectional view of the configuration in the vicinity of the sheet-supply roller 21. FIG. 4 is a plan view showing the configuration of components assembled along the rotational shaft 71 of the sheet-supply roller 21, wherein the box 15 and a rubber film 73 (to be described later) are shown in cross section. The substantially half-moon shape of the sheet-supply roller 21 includes a small portion 21*a* and a large portion 21*b*. Distance, or radius, from the rotational shaft 71 to the outer surface of the sheet-supply roller 21 is greater at the large portion 21*a* than at the small portion 21*b*. The sheet-supply roller 21 is formed to rotate integrally with the rotational shaft 71 and the sheet-supply gear 61. The rubber film 73 covers the outer periphery of the small portion 21*a* and the large portion 21*b*. As can be seen in FIG. 4, although only one has been referred to in order to facilitate explanation in the present embodiment, two sheet-supply rollers 21 are provided on the rotational shaft 61 separated in the axial direction of the rotational shaft 71. Three disc-shaped sheet-supply collars 75 are freely rotatably mounted on the rotational shaft 71. Each of the sheet-supply collars 75 has a radius larger than the radius of the small portion 21*a* and smaller than the radius of the large portion 21*b*.

The sheet-support tray 17 is capable of supporting sheets in a variety of sizes with their front edges aligned opposite the sheet-supply gear 61. The sheet-supply roller 21 and the sheet-supply collar 75 separated furthest from the sheet-supply gear 61 are disposed so as to confront to the substantial center of the narrowest-width sheet P that is, a postcard-size sheet, supportable by the sheet-support tray 17. A stopper 77 is formed integrally with the rotational shaft 71 at a position confronting the postcard surface.

As viewed in FIG. 3, the stopper 77 is disposed so as to protrude away from a retreating Ride, when the sheet-supply roller 21 rotates in the counterclockwise direction, that is, the direction for feeding sheets P from the stack, of the small portion 21*a* of the sheet-supply roller 21. The stopper 77 has a radius the same or slightly smaller than that of the large portion 21*b* of the sheet-supply roller 21 and larger than the radius of the sheet-supply collar 75. The stopper 77 is formed in a substantially quarter-circle plate shape and is disposed perpendicular to the rotational shaft 71. The stopper 77 includes a tapered tip 77*c* formed between an arc portion 77*b* and a linear portion 77*a*. A radial edge RE between the rotational shaft 71 and linear portion 77*a* has a radius shorter than that of the sheet-supply collar 75. The linear portion 77*a* and the tapered tip 77*c* have a smooth surface that provides little resistance to objects sliding thereacross.

A coil spring 79 is suspended between the sheet support tray 17 and the sheet-supply cassette 19. The coil spring 79 is applied with tension and therefore urges the sheet-support tray 17 toward the sheet-supply roller 21. For this reason, sheets P can be pressed against the large portion 21*b* and reliably supplied toward the print head 13*a*.

Next, an explanation will be provided for operations of the ink jet printer 1, particularly sheet-supply operations. First, when the sheet-supply roller 21 is in a stop posture as shown in FIG. 3, the small portion 21*a* is in confrontation with the sheet-support tray 17 and the coil spring 79 urges the sheet-support tray 17 to abut against the sheet-supply collar 75 with a sheet P sandwiched therebetween. In this way, a predetermined gap is maintained between the sheet P and the rotational shaft 71 even when the small portion 21*a* confronts the sheet-support tray 17. Also, as will be described in further detail later, the tapered tip 77*c* of the stopper 77 abuts and is pressed against the upper surface of the uppermost sheet P by the weight of the large portion 21*b* of the sheet-supply roller 21. Further, the sheet-supply gear 61 and the swing frame 53 are disposed at positions shown in FIG. 2(*a*), that is to say, the pin 65 and the engagement rib 53*a* are in engagement and the planetary gear 55 and the toothless portion 61*a* are in opposition with each other. It should be noted that at this time, the gear 63 is shifted downward by its own weight on the minor axis of the shaft 67 and so is not in meshing engagement with the sheet-supply gear 61.

When sheet-supply starts, the motor 33 rotates in its reverse direction, that is, the counterclockwise direction as viewed in FIG. 1. Rotational force of the motor 33 is transmitted to the gear 47 via the gear 37. The gear 47 rotates in the counterclockwise direction integrally with the transport roller 53. It should be noted that when the transport roller 23 rotates in the counterclockwise direction, it is rotating in a direction opposite the direction required to transport a print sheet P. Rotational force of the motor 33 is also transmitted to the gear 43 via the gears 37, 39, 41. The discharge roller 29 rotates integrally with the gear 43 in the counterclockwise direction. The sun gear 51 rotates in clockwise direction in association with the gear 47. For this reason, the swing frame 53 swings clockwise in a direction indicated by an arrow B in FIG. 2(*b*).

As a result, the pin 65 and the engagement rib 53*a* switch from their engagement condition shown in FIG. 2(*a*) to out of engagement as shown in FIG. 2(*b*). The gear 63 is pressed upward by the planetary gear 57 and brought into engagement with the sheet-supply gear 61 so that rotational force of the sun gear 51 is transmitted to the sheet-supply gear 61 via the planetary gear. 57 and the gear 63. The sheet-supply gear 61 rotates in the clockwise direction indicated by an arrow E of FIG. 2(*a*) and 2(*b*) integrally with the sheet-supply roller 21. As a result, the large portion 21*b* of the sheet-supply roller 21 contacts the uppermost sheet P supported on the sheet-support tray 17, and feeds the uppermost sheet P toward the transport roller 23. Because the transport roller 23 rotates in a reverse direction from the direction it should rotate to transport a sheet P, the front edge of the sheet P is stopped where the transport roller 23 and the sheet-pressing member 25 contact each other.

The sheet P therefore bends between the sheet-supply roller 21 and the transport roller 23, and the front edge of the sheet P is brought into alignment parallel with the rotational axis of the transport roller 23. After the toothless portion 61*a* passes the position confronting the planetary gear 55, the motor begins to rotate in its forward direction so that rotational force in an opposite direction of that described above is transmitted to the gears 37 through 47. For this reason, the transport roller 23 and the discharge roller 29 rotate in the clockwise direction, which is rotational direction for transporting a sheet P. After the print head 13 forms an image on the surface of a sheet P, the printed sheet P is discharged onto the discharge tray 27. In association with the above-described clockwise rotation, the swing frame 53 swings counterclockwise in association with the sun gear 51 rotating counterclockwise as indicated by an arrow C in FIG. 2(*c*). For this reason, the planetary gear 55 comes into meshing engagement with the sheet-supply gear 61 so that rotational force is transmitted to the sun gear 51. Therefore, the sheet-supply roller 21 continues to rotate in the direction for transporting a sheet P until it rotates approximately 360 degrees into its stop posture, that is, until the condition shown in FIG. 2(*a*).

When the sheet-supply roller 21 reaches its stop posture, the toothless portion 61*a* is in confrontation with the planetary gear 55 so that drive force from the motor 33 is not transmitted to the sheet-supply gear 61. That is to say, transmission of rotational force to the sheet-supply roller 21 is interrupted. Because the tapered tip 77*c* of the stopper 77 abuts the surface of the uppermost sheet P on the sheet-support tray 17, the sheet-supply roller 21 is prevented from rotating by its own weight in a direction opposite that for transporting a sheet P. Said differently, when the sheet-supply roller 21 is in its stop posture as shown in FIG. 3, the small portion 21 faces downward in confrontation with the sheet P, and the large portion 21*b* faces upward. For this reason, the center of gravity of the sheet-supply roller 21 is off center upward to the side of the large portion 21*b*. Therefore, the sheet-supply roller 21 is in its stop position, the weight of the sheet-supply roller 21 urges the sheet-supply roller 21 to rotate in the clockwise direction, which is the direction opposite that for transporting sheets P. However, because the stopper 77 abuts against the uppermost sheet P, the rotation of the sheet-supply roller 21 is prevented. Also, the large portion 21*b* is prevented from contacting and applying resistance to a prior sheet P presently transported by the transport-roller 23. For this reason, the initial position of the sheet-feed roller 21 at start of sheet-supply and timing of sheet-supply itself will not be adversary affected.

Because the stopper 77 is formed in a flat-plate shape with the linear portion 77*a* provided substantially parallel to the transport direction of the sheet P when the sheet-supply roller 21 is in its stop posture, the stopper 77 will apply almost no resistance to a sheet P transported by the transport roller 23. Because the tapered tip 77*c* and linear portion 77*s* are smooth, sheets P being transported by the transport roller 23 will slide easily along them and the next sheet P in the stack. Also, the sheet-supply collars 75 will reliably separate the sheet P from the small portion 21 of the sheet-supply roller 21. Furthermore, the sheet-supply collar 75 is formed in a disc shape freely rotatable in association with transport of the sheet P. For this reason, resistance can be reliably prevented from being applied to the sheet P transported by the transport roller 23. Were either of the stopper 77 and the sheet-supply collar 75 to contact the transported sheet P, a small amount of rotational force would be generated in the sheet-supply roller 21 in the sheet-supply direction. Rotation in this direction is prevented by engagement between the pin 65 and the engagement rib 53*a*. Accordingly, sheet supply in the ink jet printer 1 can be smoothly performed.

In the ink jet printer 1, the stopper 77 is positioned to abut the surface of any size sheet P that the sheet-support tray 11 is capable of supporting as shown in FIG. 4. For this reason, regardless of what size of sheet P can be supported on the sheet-support tray 17, undesirable rotation of the sheet-supply roller 21 can be effectively prevented.

While the invention has been described in detail with reference to specific embodiments thereof, it would be apparent to those skilled in the art that various changes and modifications may be made therein without departing from the spirit of the invention, the scope of which is defined by the attached claims.

For example, a flat-plate shaped stopper 77 was used to support the sheet-feed roller 21. However, a different type member could be used to support the sheet-feed roller 21 by abutting the surface of the sheet P.

Further, the present invention could be applied to a variety of sheet-feed devices other than those used in an ink jet printer. However, ink jet printers usually need to be smaller and have a higher resolution than other image forming devices. Also, demands are being placed on ink jet printers to process greater and greater volumes of data. For this reason, when the sheet-supply roller 21 is in a stop condition, the sheet-supply roller 21 is released from rotational force of the drive motor 33 as described above. The motor 33 need not be controlled to maintain the position of the sheet-supply portion 21, thereby reducing the burden on the CPU. As a result, when the present invention is applied to an ink jet printer, the effects of the present invention are particularly pronounced.

What is claimed is:

1. A sheet-supply device comprising:

a sheet support supporting a stack of cut sheets including an uppermost sheet;

a rotatable sheet-supply roller having a rotational shaft and an outer peripheral surface around the rotational shaft, the peripheral surface including a sheet contact portion and a sheet non-contact portion alternately in confrontation with the uppermost sheet depending on the rotational phase of the sheet-supply roller, the sheet contact portion and the rotational shaft having a distance therebetween greater than a distance between the non-contact portion and the rotational shaft;

drive means capable of switching between a transmission condition for transmitting rotational force to the sheet-supply roller and a non-transmission condition for interrupting transmission of rotational force to the sheet-supply roller, the drive means serially feeding cut sheets from the sheet support by switching to the transmission condition and rotating the sheet-supply roller with the sheet contact portion in contact with the uppermost cut sheet; and a bearing member abutting, when the drive means is in the non-transmission condition, the uppermost cut sheet to support the sheet-supply roller oriented with the sheet non-contact portion in confrontation with the uppermost cut sheet.

2. A sheet-supply device as claimed in claim 1, wherein the bearing member is formed in a plate shape extending perpendicular to the rotational shaft of the sheet-supply roller and has a tip for abutting the uppermost sheet when the drive means is in the non-transmission condition.

3. A sheet-supply device as claimed in claim 2, including a rotation prevention means for preventing, when the drive means is in the non-transmission condition, rotational force generated by contact between the bearing member and a transported sheet from rotating the sheet-supply roller about the rotational axis.

4. A sheet-supply device as claimed in claim 3, wherein the rotation prevention means includes:

a sheet-supply gear fixedly supported on the rotational shaft and having a pin protruding substantially parallel with the rotational shaft; and a swing plate having a rib engaging the pin in the non-transmission condition, the swing plate swinging to disengage engagement between the rib and the pin to enter the transmission condition.

5. A sheet-supply device as claimed in claim 2, wherein the drive means includes:

a sheet-supply gear fixedly supported on the rotational shaft and having a toothless portion at its periphery:

a drive motor capable of switching between a forward and a reverse rotational direction; and a swing member including:

a pivotal gear rotating in association with the drive motor;

a swing plate swinging between a first position and a second position in association with switching of rotational direction of the pivotal gear;

a first gear rotating the sheet-supply gear when the swing plate is in the first position; and a second gear confronting the sheet-supply gear when the swing plate is in the second position so as to engage with the sheet-supply gear in the transmission condition and confront the toothless portion in the non-transmission condition.

6. A sheet-supply device as claimed in claim 5, wherein the drive means further includes a third gear freely rotatably disposed on a shaft ellipsoidal in cross section and between the sheet-supply gear and the first gear, the third gear being pressed into engagement with the sheet-supply gear by the first gear when the swing plate is in the first position so that the first gear indirectly rotates the sheet-supply gear to enter the transmission condition from the non-transmission condition.

7. A sheet-supply device as claimed in claim 2, further comprising a gap maintenance means for maintaining a predetermined gap between the uppermost sheet and the rotational shaft of the sheet-supply-roller.

8. A sheet-supply device as claimed in claim 2, wherein:

the sheet support is capable of supporting a plurality of different sized cut sheets stacked with at least one common position; and the bearing member is disposed at a position where it will abut the at least one common position of the plurality of different sized sheets in the non-transmission condition.

9. A sheet-supply device as claimed in claim 1, further comprising a gap maintenance means for maintaining a predetermined gap between the uppermost sheet and the rotational shaft of the sheet-supply roller.

10. A sheet-supply device as claimed in claim 9, wherein at least one of the sheet support and the sheet-supply roller are urged in a direction to bring the sheet support and the sheet-supply roller into abutment, the gap maintenance means maintaining the predetermined gap against the urging in the direction.

11. A sheet-supply device as claimed in claim 10, wherein the gap maintenance means includes a disk provided freely rotatable to the rotational shaft of the sheet-supply roller and having a radius from the rotational shaft greater than the distance between the rotational shaft and the non-contact portion and less than the distance between the rotational shaft and the sheet contact portion.

12. A sheet-supply device as claimed in claim 11, wherein:

the sheet support is capable of supporting a plurality of different sized cut sheets stacked with at least one common position; and the bearing member is disposed at a position where it will abut the at least one common position of the plurality of different sized sheets in the non-transmission condition.

13. A sheet-supply device as claimed in claim 9, wherein the gap maintenance means includes a disk provided freely rotatable to the rotational shaft of the sheet-supply roller and having a radius from the rotational shaft greater than the distance between the rotational shaft and the non-contact portion and less than the distance between the rotational shaft and the sheet contact portion.

14. A sheet-supply device as claimed in claim 9, wherein:

the sheet support is capable of supporting a plurality of different sized cut sheets stacked with at least one common position; and the bearing member is disposed at a position where it will abut the at least one common position of the plurality of different sized sheets in the non-transmission condition.

15. A sheet-supply device as claimed in claim 1, wherein the bearing member is fixed to the rotational shaft so as to rotate integrally with the sheet-supply roller and abuts the uppermost sheet so as to prevent weight of the sheet-supply roller from rotating the sheet-supply roller about the rotational shaft.

16. A sheet-supply device as claimed in claim 1, wherein:

the sheet support is capable of supporting a plurality of different sized cut sheets stacked with at least one common position; and the bearing member is disposed at a position where it will abut the at least one common position of the plurality of different sized sheets in the non-transmission condition.

17. A sheet-supply device as claimed in claim 1, wherein the sheet contact portion of the sheet-supply roller is arc-shaped.

18. A sheet-supply device as claimed in claim 1, wherein the drive means includes:

a sheet-supply gear fixedly supported on the rotational shaft and having a toothless portion at its periphery;

a drive motor capable switching between a forward and a reverse rotational direction; and a swing member including:

a pivotal gear rotating in association with the drive motor;

a swing plate swinging between a first position and a second position in association with switching of rotational direction of the pivotal gear;

a first gear rotating the sheet-supply gear when the swing plate is in the first position; and a second gear confronting the sheet-supply gear when the swing plate is in the second position so as to engage with the sheet-supply gear in the transmission condition and confront the toothless portion in the non-transmission condition.

19. A sheet-supply device as claimed in claim 18, wherein:

the sheet-supply gear further has a pin near the toothless portion; and the swing member further including a rib protruding from the swing plate near the second gear and engaging with the pin in the non-transmission portion to prevent rotational force generated by contact between the bearing member and a transported sheet from rotating the rotational axis.

20. A sheet-supply device as claimed in claim 18, wherein the drive means further includes a third gear freely rotatably disposed on a shaft ellipsoidal in cross section and between the sheet-supply gear and the first gear, the third gear being pressed into engagement with the sheet-supply gear by the first gear when the swing plate is in the first position so that the first gear indirectly rotates the sheet-supply gear to enter the transmission condition from the non-transmission condition.

21. A sheet-supply device as claimed in claim 1, wherein the sheet-supply device is used in an ink jet printer.

* * * * *